US006520329B1

(12) United States Patent
Fuchs et al.

(10) Patent No.: US 6,520,329 B1
(45) Date of Patent: Feb. 18, 2003

(54) PACKAGING FOR PLANIFORM OBJECTS/ PRODUCTS

(75) Inventors: Michael Fuchs, Dischingen (DE); Günter Simon, Hillesheim (DE); Notger Weber, Neuwied (DE)

(73) Assignees: LTS Lohmann Thapie-Systeme AG, Andernach (DE); Carl Edelmann GmbH & Co. KG, Heindenheim (DE)

( * ) Notice: Subject to any disclaimer, the term of this patent is extended or adjusted under 35 U.S.C. 154(b) by 0 days.

(21) Appl. No.: 09/831,984

(22) PCT Filed: Nov. 20, 1999

(86) PCT No.: PCT/EP99/08962

§ 371 (c)(1),
(2), (4) Date: Aug. 17, 2001

(87) PCT Pub. No.: WO00/34145

PCT Pub. Date: Jun. 15, 2000

(30) Foreign Application Priority Data

Dec. 9, 1998 (DE) ..... 198 56 845
Mar. 3, 1999 (DE) ..... 199 09 225

(51) Int. Cl.[7] ..... B65D 75/58

(52) U.S. Cl. ..... 206/449; 206/39; 206/469; 206/532; 206/725

(58) Field of Search ..... 206/39, 469, 470, 206/467, 489, 532, 449, 725

(56) References Cited

U.S. PATENT DOCUMENTS 2,834,456 A * 5/1958 Langer ..... 206/532
2,892,541 A * 6/1959 Hahn ..... 206/470
2,993,590 A * 7/1961 Denton ..... 206/469
3,004,661 A * 10/1961 Schumann ..... 206/469
3,063,557 A * 11/1962 Scholl ..... 206/469
3,279,596 A * 10/1966 Prym et al. ..... 206/469
3,414,414 A * 12/1968 Christine et al. ..... 206/469
3,811,564 A * 5/1974 Braber ..... 206/469
3,912,081 A * 10/1975 Haines et al. ..... 206/469
3,970,194 A 7/1976 Iten
4,294,361 A 10/1981 Margulies et al.
4,803,048 A * 2/1989 Nason ..... 206/469
5,050,739 A * 9/1991 Hannan et al. ..... 206/534
5,209,354 A * 5/1993 Thornhill et al. ..... 206/469
5,325,968 A 7/1994 Sowden

* cited by examiner

*Primary Examiner*—Jim Foster
(74) *Attorney, Agent, or Firm*—Frommer Lawrence & Haug LLP

(57) ABSTRACT

The invention relates to a packaging for planiform objects/ products such as susceptors, wafers, chewing gum, TTS, TDDS, TDS, stamps, microchips or like. Said packaging consists of a support card (1) with one or more cavities (2) for receiving the object(s). The upper side of said support card is covered by a cover film (3) which occludes the cavities and which is sealed with th support card at sealing lines (4) at least in the marginal area around the cavities in such a manner that sad film can be torn open. Said sealing lines are surrounded by a weakened line (c) the cover film which merges into the contour of a tab (3*a*) for grasping and manually tearing open the cover film above the respective cavity.

8 Claims, 2 Drawing Sheets

PACKAGING FOR PLANIFORM OBJECTS/ PRODUCTS

DESCRIPTION

The invention relates to a packaging for planiform objects, for example flexible pharmaceutical flat bodies, in particular susceptors, cachets, wafers, transdermal therapeutic systems (TTS) or transdermal drug delivery systems (TDDS or TDS), chewing gum, microchips, stamps or the like.

So-called blister packs have become established in the field of packaging of tablets, said blister packs consisting of a support card with a multiplicity of cavities or cups in a matrix-type pattern which are intended to individually receive tablets, pills, capsules or the like, and of a cover film which is welded to the upper side of the support card and occludes the cups. This film generally consists of aluminum which, on the side facing the support card, is provided with a layer of polypropylene, polyethylene or sealing varnish which permits welding. The filled blister cards are packaged individually or severally, together with an insert leaflet, in a folding carton of suitable size.

To remove a tablet from one of the cups, the tablet is pressed upwards against the cover film from underneath using the thumb, and the cover film thus bursts and tears open in the area of the cup. This procedure is made possible because of the softness of the material of the support card and the rigidness of the tablets, in conjunction with the low strength of the cover film. However, it is not possible to remove soft or sensitive objects from the cup using this procedure, because the latter can damage sensitive objects.

Pharmaceutical preparations have also recently become commercially available in which the pharmaceutical active substance is accommodated in a sensitive and relatively flat plaster—a small cachet or a wafer-thin, specially produced film—to be taken up on a patient's tongue in order to reach the patient's circulation without passing through the stomach. Flat objects of this type, which in addition are insufficiently rigid to be pressed through a cover film, are not suitable for packing in a blister pack of the abovementioned type. The same applies to brittle thin objects such as semiconductor wafers.

It is an object of the invention to make available a packaging of the type mentioned at the outset, which permits a simple packing procedure and straightforward individual removal of the individual planiform objects/products from the packaging.

An object of the invention is achieved by a packaging comprising a support card with one or more cavities each intended to receive one of the objects, the upper side of said support card being covered by a cover film which occludes the cavities and which is sealed to the support card at sealing lines at least in the margin area around the cavities in such a manner that said film can be torn open, said sealing lines each being surrounded by a weakened line merges into the contour or the boundary cutting line of a pull tab for gripping and manually tearing open the cover film over the respective cavity.

The invention makes use of a support card which is similar to that of the prior art and which has cavities for receiving the planiform objects/products. The card is covered by a cover film which is connected to it and which occludes the cavities. Unlike in the prior art, however, the card is not designed for the packaged planiform objects to be removed by pressing them through the cover film from underneath. Instead, the cover film is designed in conjunction with the support card in such a way that the chambers formed by the cavities can be opened individually and only in the area of these chambers by pulling off a section of the cover film lying over the cavity in question.

The support card can preferably be made of board since, when opening the chambers formed by the cavities, the stiffness of the board is not an obstacle but on the contrary makes the opening procedure even easier. The board material, preferably with a thickness of 0.3 to 0.5 mm, is preferably coated with a sealable varnish or a sealable film which not only forms a vapor barrier but is also used for sealing to the cover film. Tearing open of the individual chambers is made possible by a material separation between board and coating.

Depending on the thickness of the flat bodies to be received, the cavities are set back from the surface of the support card, by 0.5 to 1 mm for example. They are created in particular and preferably by embossing the support card material when producing the blank.

The cover film is sealed to the support card, at least in the area around the edges of the cavities, in order to ensure a tight seal of the chambers formed by the cavities. To make it easier to tear open the chambers, the cover film is provided with weakened lines, for example a perforation or scored line, around the edges of the cavities outside the abovementioned seals. To make tearing open easier, a pull tab can be formed on each section of the cover film to be torn open, which pull tab could be gripped by the fingers. This pull tab would then preferably be securely connected to the underlying material of the support card, and the section of the support card lying under the tab would be delimited from this by a weakened line so that, in order to open the associated chamber, this section could be easily broken away from the card and torn off together with the pull tab and the contiguous section of the cover film.

The cover film can preferably also be securely connected, for example adhesively bonded or sealed, to the support card in a matrix pattern which is aligned with the distribution of the cavities, in order to prevent an uncontrolled peeling-off of the cover film from the support card when the cavities are torn open.

The packaging preferably also includes a sleeve-like envelope which receives the support card and can be locally connected releasably to the support card in order to form an original closure which not only holds support card and envelope together, but also provides a guarantee that the packaging has not been tampered with prior to its first use.

In a development of the invention, a further support card can be applied to at least one of the edges of the support card, which further support card can be of the same design as the above-described "main" support card in order to increase the holding volume of the packaging, but can also be an information support card which, for example, replaces the insert leaflet required for medicaments. It is also possible, on two or three edges of the support card, to apply additional support cards, of which one for example is an information support card. The connection of these additional support cards to the main support card could for example be on perforation lines, so that the additional support card(s) can be torn off from the main support card when no longer needed. The envelope too can be closed on three or four sides by adhesive bonding, sealing or otherwise.

It is essential for the invention that the cover film can be easily detached from the support card in the area of the cavities. The area of the sealing line must therefore be easy to tear open, either by the sealed material combination being separable, or by a lining coming loose from a base, which can easily be achieved when board is used. As has already been described, the support card can be made of board, or, conversely, the support card can also be made of a sealable plastic while the cover film can be made of a lined or varnished board.

The invention is explained in more detail below with reference to an illustrative embodiment which is represented in the drawings, in which.

Figure 1:
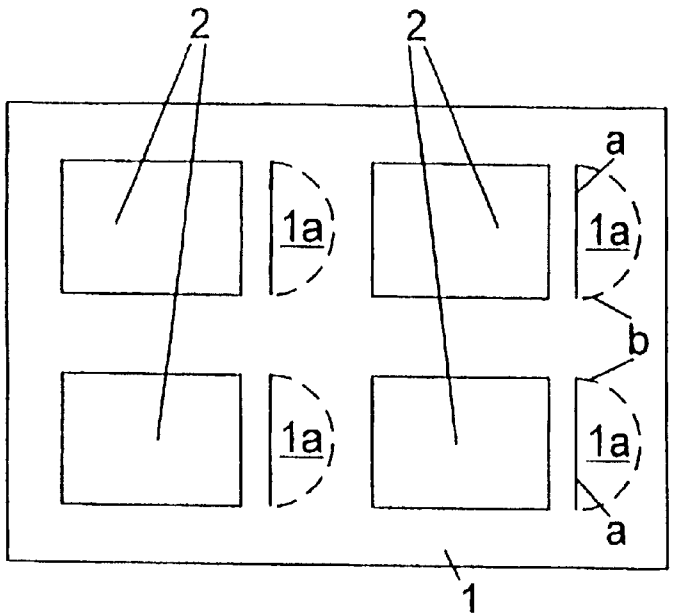
FIG. 1 shows a plan view of a support card approximately true to scale in the embossed state.

According to FIG. 1, the support card 1 consists of a rectangular blank, preferably of board, which in the illustrated example is provided with four rectangular cavities 2 which are formed by embossing the material of the support card 1. Adjacent to the narrow sides of the cavities 2, crescent-shaped areas or fields 1*a* are in each case delimited in the support card 1, generated specifically by a straight cutting or weakened line a adjacent in each case to the narrow side of the cavity 2 and by a crescent-shaped interrupted break line b which connects the ends of the straight cutting line a to each other.

Figure 2:
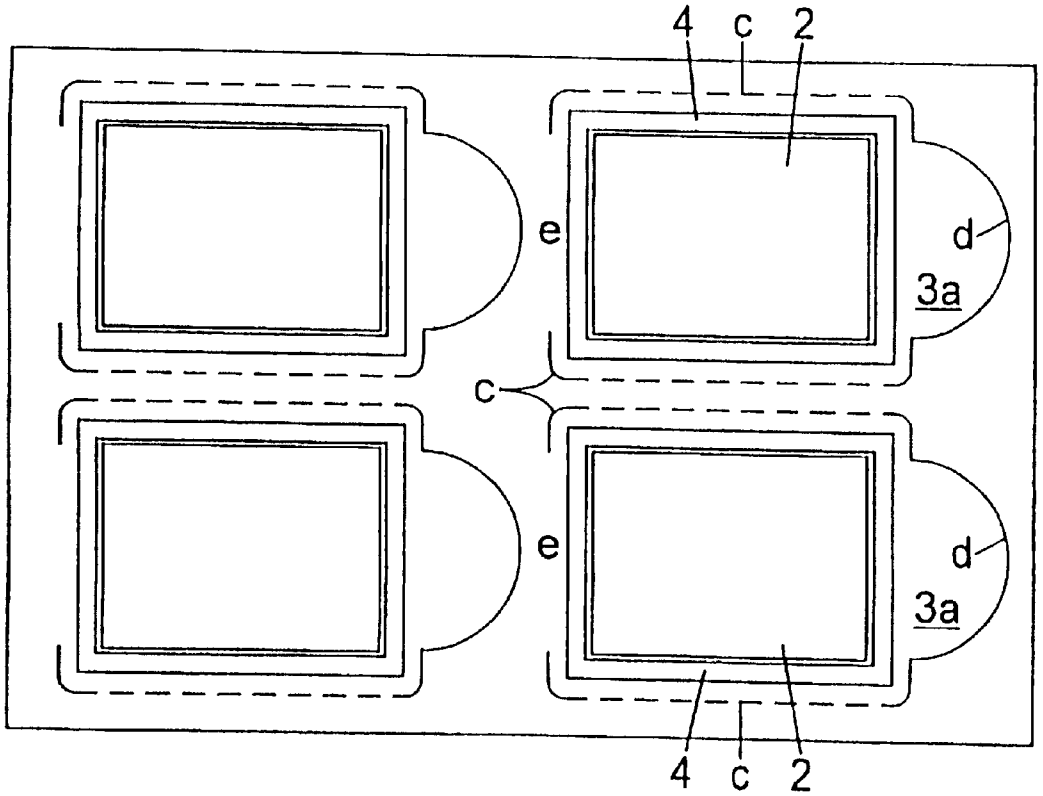
FIG. 2 shows a plan view of a support card on an enlarged scale and provided with a cover film.
Figure 3:
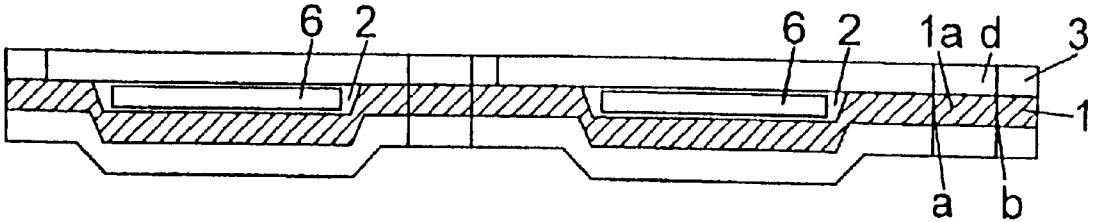
FIG. 3 shows a longitudinal section through the support card in FIG. 2.

According to FIGS. 2 and 3, the support card 1 is covered by a cover film 3. It should be noted here that FIG. 3 shows the thicknesses of the support card 1 and of the cover film 3 on a greatly exaggerated scale.

The cover film 3 is sealed to the support card 1 in the edge area around the cavities 2 in such a way that it can be torn open. The sealed lines or areas 4 surround each of the cavities 2 like a frame. Outside the sealed areas 4, the cover film 3 is provided with weakened lines c parallel to the long sides of the cavities 2. These merge into crescent-shaped cutting lines d which lie over the break lines b in the support card 1. On that side of the cavity 2 lying opposite the cutting line d in each case, in the area e, the weakened line c can be absent. The area 3*a* of the cover film 3 enclosed by the cutting line d is preferably adhesively bonded, welded or sealed to the underlying crescent-shaped section 1*a* of the support card 1.

FIG. 3 shows, on the underside of the support card 1, a lining 5 which acts as a vapor barrier. FIG. 3 also shows the filling of the cavities 2 with, for example, flat medicaments 6.

Figure 4:
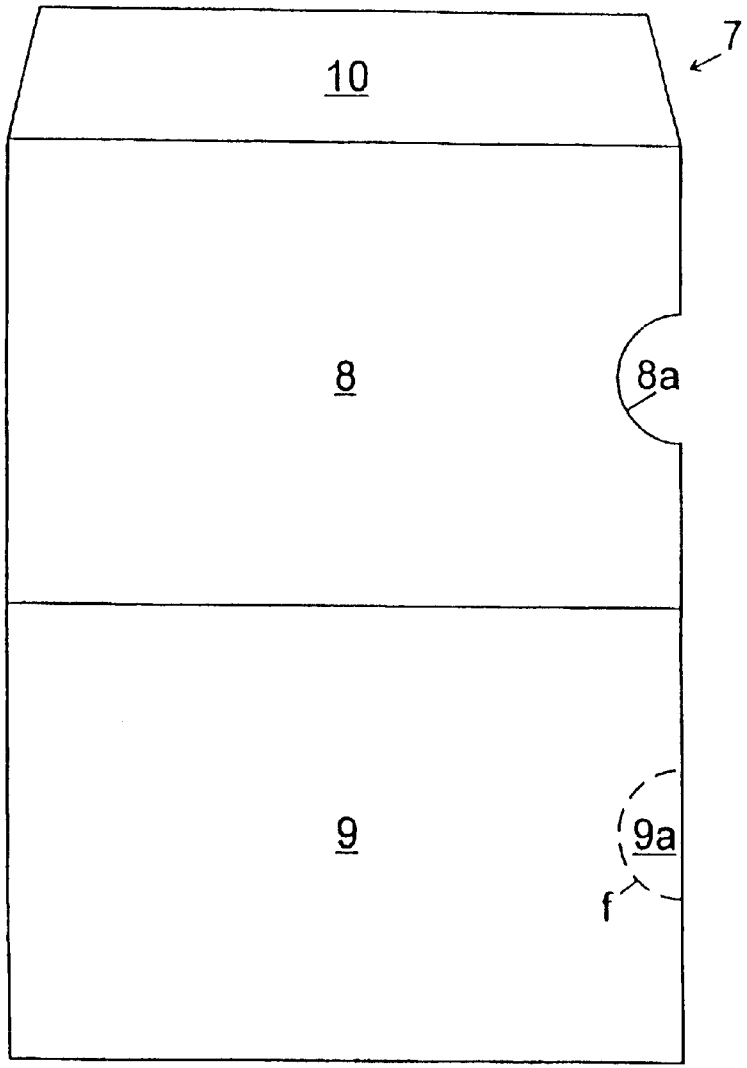
FIG. 4 shows the blank of an envelope for the support card.

An envelope whose blank 7 is shown in FIG. 4 is used to accommodate a filled and sealed support card. This envelope consists of two main areas 8 and 9 and of an adhesive tab 10 contiguous with one main area 8, and they are delimited from each other by fold lines. By folding and gluing, this blank can be formed into a flat envelope. One main area 8 has a crescent-shaped cutout 8*a*, while the other main area 9 has, at the position corresponding to the cutout 8*a*, an approximately semicircular section 9*a* which is delimited by a semicircular break line f.

In the packaging procedure, the blank 7 of the envelope is folded about a filled support card 1 and glued with the aid of the adhesive tab 10. The crescent-shaped section 9*a* of one envelope area 9 is thus adhesively bonded to the filled support card 1, preferably to its underside or to the lining 5 applied there.

A further adhesive tab can be applied to the area 8 or 9, on the side opposite 8*a* or 9*a*, in order to close this side too. This adhesive tab is then adhesively bonded to the side 8 or 9 after folding.

In order to remove the support card 1 from the flat envelope during use, the break line f is broken open and the section 9*a* is thus separated from the main area 9, so that the support card 1 can then be withdrawn from the envelope.

It is then possible for the cover film 3 over one of the cavities 2 to be torn away. For this purpose, the crescent-shaped section 1*a* in question can be broken away from the support card 1, which is easy to do since the cover film 3 is provided at the point in question with the crescent-shaped cutting line d. The section 1*a* of the support card 1 and the section 3*a* of the cover film 3 connected to it then form a gripping tab, facilitating the limited tearing-open of the cover film 3 over the cavity 2 in question. This section of the cover film 3 easily tears open at the weakened line c, with the seal on the frame-shaped sealed area 4 coming loose. The cavity 2 is thus freely accessible and its contents 6 can be removed. So that the torn-off material part of the cover film 3 does not have to be disposed of separately, it does not need to be detached completely from the support card 1. For this reason, the weakened line is absent in the area e lying opposite the crescent-shaped cutting line d. Of course, it is also possible to form the weakened line c in the aforementioned area e too, in order to facilitate complete tearing-off of the part of the cover film 3 formerly covering the cavity 2.

What is claimed is:

1. A packaging for planiform objects comprising a support card with one or more cavities each intended to receive one of the objects, the upper side of said support card being covered by a cover film which occludes the cavities and which is sealed to the support card at sealing lines at least the margin area around the cavities in such a manner that said film can be torn open, said sealing lines each being surrounded by a weakened line in the cover film which said weakened line merges into the contour of the boundary cutting line of a pull tab for gripping and manually tearing open the cover film over the respective cavity, and a flat envelope of board or plastic film, which surrounds said support card wherein on of the areas forming the flat envelope has, near the edge of one open end, a section which ends at the edge and which is delimited from the rest of the area by a weakened line which can be broken open, and is securely connected to the support card.

2. The packaging as claimed in claim 1, wherein the section which ends at the edge and which is delimited from the rest of the area by a weakened line which can be broken away from the envelope area is semicircular and is about the width of the tip of a thumb, and the opposite area of the envelope adjacent to said section which can be broken away has a cutout of comparable contour.

3. The packaging as claimed in claim 1, wherein the envelope is open at two opposite ends.

4. The packaging as claimed in claim 1, wherein the envelope is closed at three ends.

5. The packaging as claimed in claim 1, wherein the packaging is suitable for flexible pharmaceutical that bodies.

6. The packaging as claimed in claim 1, wherein the flexible pharmaceutical flat bodies are selected from a group consisting of susceptors, cachets, wafers, transdermal therapeutic systems and transdermal drug delivery systems.

7. The packaging as claimed in claim 1, wherein the planiform objects are selected from the group consisting of chewing gum, microchips and stamps.

8. The packaging as claimed in claim 1 wherein the flat envelope is adhesively bonded or sealed to the support card.

* * * * *